US007666060B2

(12) United States Patent
Cheung

(10) Patent No.: US 7,666,060 B2
(45) Date of Patent: Feb. 23, 2010

(54) SAFETY BRA SUPPORT

(76) Inventor: Suilung Cheung, 1 Block Two, No. 17, Chang Zhen Road, Kaiping City, Guangdong (CN) 529300

( * ) Notice: Subject to any disclaimer, the term of this patent is extended or adjusted under 35 U.S.C. 154(b) by 0 days.

(21) Appl. No.: 12/000,529

(22) Filed: Dec. 13, 2007

(65) Prior Publication Data

US 2009/0156095 A1 Jun. 18, 2009

(51) Int. Cl.
*A41C 3/00* (2006.01)

(52) U.S. Cl. ..... 450/41; 450/47; 450/51

(58) Field of Classification Search ..... 450/41, 450/45–48, 51, 52; 2/255–257, 260, 260.1, 2/261, 264, 259

See application file for complete search history.

(56) References Cited

U.S. PATENT DOCUMENTS 3,114,374 A * 12/1963 Chalfin et al. ..... 450/41

* cited by examiner

*Primary Examiner*—Gloria Hale
(74) *Attorney, Agent, or Firm*—IPFortune LLC; Ruay L. Ho

(57) ABSTRACT

The present disclosure provides a safety bra support comprising an arc-shaped steel wire in which the special characteristic is that at least two ends of the underwire are enclosed with at least one set of thermally contractible cases made of polymeric materials. The external end of the thermally contractible case is a soft tube which protrudes outwardly beyond the end of the arc-shaped underwire, and such a soft tube is bendable and flexible, ensuring the tips of the underwire be placed at the end stitches of the sleeve. Because the above described structure is used, the present disclosure not only can effectively prevent injuries to users caused by the ends of the underwire poking through the sleeve of the bra support, but can also provide a seamless and natural fit, and the utmost comfort to wear.

13 Claims, 7 Drawing Sheets

SAFETY BRA SUPPORT

TECHNICAL FIELD

The present disclosure relates to a breast support for women's tights and brassieres, in particular, a bra support for safe use.

BACKGROUND

The arc-shaped underwire used for current bra supports is made of rigid material. When it is inserted into a sleeve which is loosely structured fabric, soft to the feel and comfortable, the two ends of the wire can easily push through the textile fabric and make a nick on the sleeve, allowing the end to poke out and to injure the user. It is therefore not safe to use. To solve this problem, some insert two rubber caps on both ends of the underwire to minimize the risk of its end poking through the sleeve to injure users.

The disadvantages of this method are as follows: 1. the insertion of a rubber cap in the end of the wire is not tight enough to be reliable; 2. the technique of manufacturing rubber caps on steel wires requires using punching shear on the ends of the wire and the rubber caps, which reduces the top area of the wire, resulting in two weak points of the underwire. When a strong force is then applied to the wire, the wire can break at the weak point and shorten the life of the product. 3. Since the rubber cap only covers the tips of the wire, the end of the underwire can not be placed at the end stitches of the fabric sleeve, and when the bra is in use, it is therefore likely that the wire will push through the fabric of the sleeve and make a hole.

The disclosed safety bra of the present disclosure overcomes one or more of the deficiencies set forth above.

SUMMARY OF THE DISCLOSURE

The object of the invention is to solve the existing problems of current bra supports by providing a bra support that is safe, comfortable, long-lasting, simple in structure and easy to manufacture. The present disclosure also means to provide a bra support with better elasticity, safety in use, and allow users to enjoy a seamless and natural fit, combined with comfort and enhanced safety.

The technical details for the present disclosure are described as follows:

The improved safety bra support of the present disclosure comprises a single or combined arc-shaped underwire with an enhanced structure where the two ends of the arc-shaped underwire are inserted into, and enclosed by, at least one set of thermally contractible cases, regardless of its length, color and diameter, made of polyethylene, and the thermally contractible case's external end can be a soft tube which protrudes out of the tips of the arc-shaped underwire, and such a soft tube is bendable and flexible, ensuring the tip of the underwire be placed right at the end stitches of the sleeve. Alternatively, the thermally contractible cases may not be extended to the wire ends which will be solely coated with protective paint instead.

To provide double the protection, the two ends of the arc-shaped underwire are coated with protective paint.

There is a variety of combinations for insertion of the underwire into the thermally contractible cases, regardless of its length, diameter or color. For example, the two ends of the underwire can be inserted into and enclosed by thermally contractible cases respectively; alternatively, the entire underwire can be inserted into and enclosed by a thermally contractible case. In this way the user will not feel the rigid underwire, thus increasing its comfort in use, and also enhancing the life of the underwire and its resistance to potential degradation from sweat and laundry detergents. The two ends of the arc-shaped underwire are reliably wrapped by the ends of the thermally contractible cases, and the outer case's external ends that extend out of the tips of the arc-shaped underwire are soft tubes, and an air cushion is formed between the underwire and the case. Alternatively, the two ends of the arc-shaped underwire may not be wrapped but exposed and coated with protective paint instead. The entire arc-shaped underwire can also be tightly wrapped by the thermally contractible cases, wherein no air cushion may be formed.

Alternatively, the underwire can be inserted into two sets of the thermally contractible cases. The insertion manner can be applied in accordance to the specific needs. For example, after the two ends of the underwire are inserted into a case, the entire underwire can be inserted into and enclosed by the second case. In addition, the underwire can be inserted into and enclosed by two sets of the thermally contractible cases directly, and an air cushion may be formed between two sets of the cases.

The present disclosure can not only prevent injury to users caused by the ends of the underwire poking through the sleeve, but also can achieve the objective of safe use and comfortable wear, providing a support that has a simple structure, is reliable, as well as easy and low cost manufacture because the present disclosure uses a support structure that the two ends of the underwire are enclosed with at least one set of thermally contractible cases made of polyethylene, with case's external end that is a soft and bendable tube protruding out of the end of the underwire, and takes full advantage of polythylene's nontoxicity, softness, better ventilation, and its characteristic that it contracts when its temperature rises to 80 degree.

In addition, since the thermally contractible case's external end is a soft bendable tube which protrudes out of the end of the underwire, it can be used to position the tip of the underwire be placed right at the end stitches of the sleeve when the underwire is inserted into the sleeve, thus providing highly-efficient protection against poke-throughs.

The present disclosure further uses the structure in which the entire underwire is inserted into and enclosed by thermally contractible cases and the two ends of the underwire are wrapped, and in which the external ends of the case extend out, forming soft tubes, while an air cushion may be formed between the underwire and the case. Such a structure of the present disclosure makes the support exceptionally elastic and users will not feel the rigid underwire, resulting in a seamless and natural fit; and also enhancing the underwire's life and its resistance to potential degradation from sweat and laundry detergents. The present disclosure can be used for a variety of brassieres in undergarments, swimming suits and evening gowns.

The following is a further description, with the attached drawings, of the invention:

DETAILED DESCRIPTION

Figure 1:
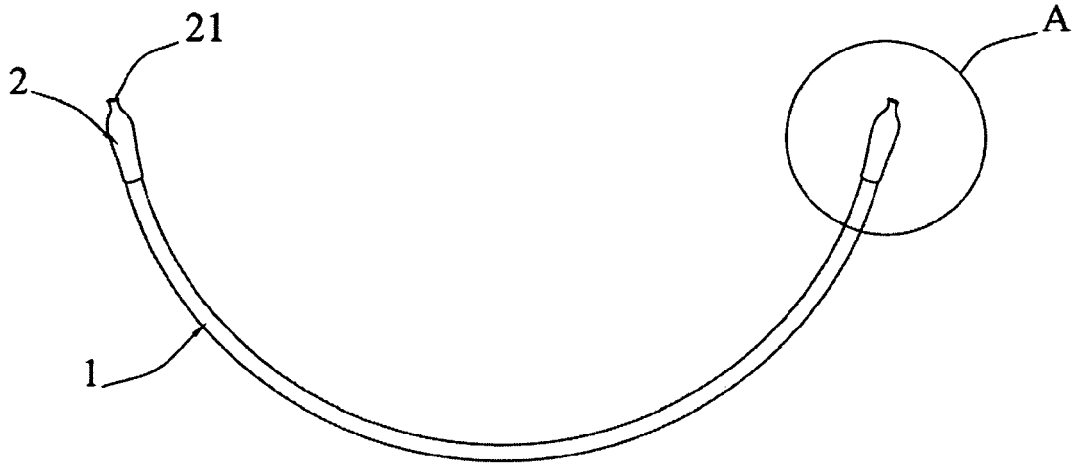
FIG. 1 illustrates a perspective view of the first embodiment.

Referring to FIG. 1, a safety bra support is shown, comprising an arc-shaped underwire 1, and the underwire which is placed in a sleeve at the lower periphery of each cup of a bra. To ensure safe and comfortable use, the end of the underwire 1 is inserted into and enclosed by one set of thermally contractible case 2 made of polyethylene. The external end of the thermally contractible case 2 extends out of the end of the underwire 1, forming a bendable soft tube 21.

Figure 2:
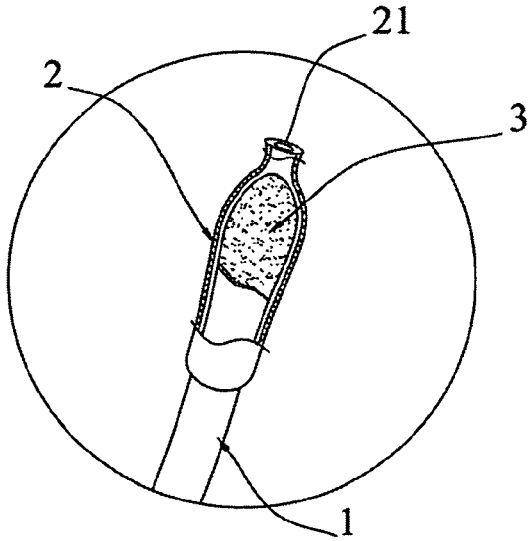
FIG. 2 illustrates a sectional view of A in FIG. 1.
Figure 3:
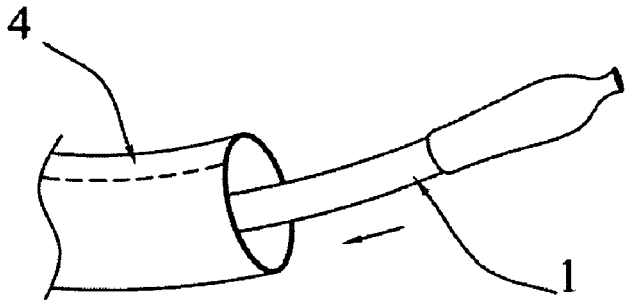
FIG. 3 illustrates a perspective view of the assembly for the first embodiment.

The structure of the end of the arc-shaped underwire 1 is shown in FIG. 2. The present disclosure takes full advantage of polythylene's characteristics such as non-toxicity, softness and flexibility, better ventilation, and contraction when temperature rises at 80 degree, and rapid contraction. The end of the underwire 1 with a paint protected coat 3 is enclosed in the thermally contractible case 2. Referring back to FIG. 1, a safety bra support is shown, comprising an arc-shaped underwire 1, and the underwire which is placed in a sleeve at the lower periphery of each cup of a bra. To ensure safe and comfortable use, the end of the underwire 1 is inserted into and enclosed by one set of thermally contractible case 2 made of polyethylene. The external end of the thermally contractible case 2 extends out of the end of the underwire 1, forming a bendable soft tube 21.

The structure of the end of the arc-shaped underwire 1 is shown in FIG. 2. The present disclosure takes full advantage of polythylene's characteristics such as non-toxicity, softness and flexibility, better ventilation, and contraction when temperature rises at 80 degree, and rapid contraction. The end of the underwire 1 with a paint protected coat 3 is enclosed in the thermally contractible case 2.

Figure 4:
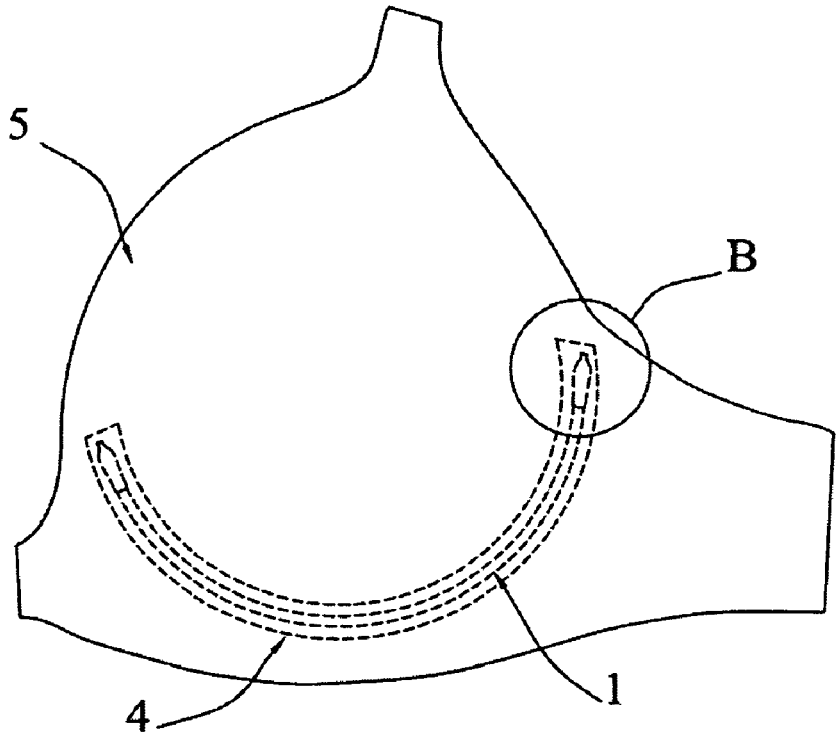
FIG. 4 illustrates an actual constitutional view of the first embodiment.
Figure 5:
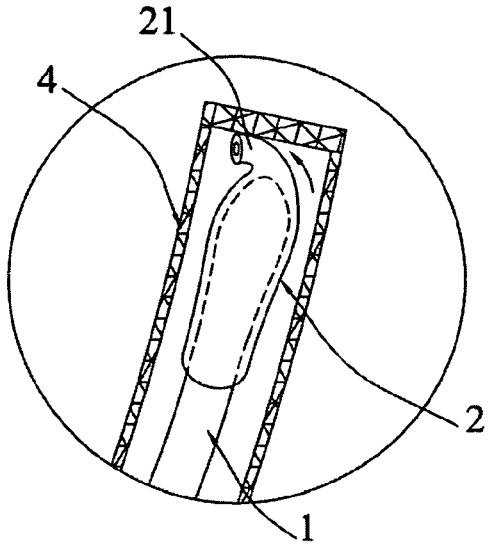
FIG. 5 illustrates an enlarged view of B in FIG. 4.

During the assembly, the arc-shaped underwire 1 is inserted into and put in place with stitches in the sleeve 4 at the lower periphery of a cup 5 of the bra, as shown in FIG. 4. Because the external end of the thermally contractible case 2 which extends out of the tip of the underwire 1 is a bendable soft tube 21, and after inserting the bra support into the sleeve 4, the soft tube 21 bends to one side when the end of the bra support is pressed against the sleeve 4, and position the tip of the underwire 1 right at the end stitches of the sleeve 4, as shown in FIG. 5. It is therefore unlikely to create holes in the sleeve, thus providing very efficient prevention against the underwire poking through and effectively avoiding injuries to the user caused by the tip of the underwire poking through the sleeve of the bra support.

Figure 6:
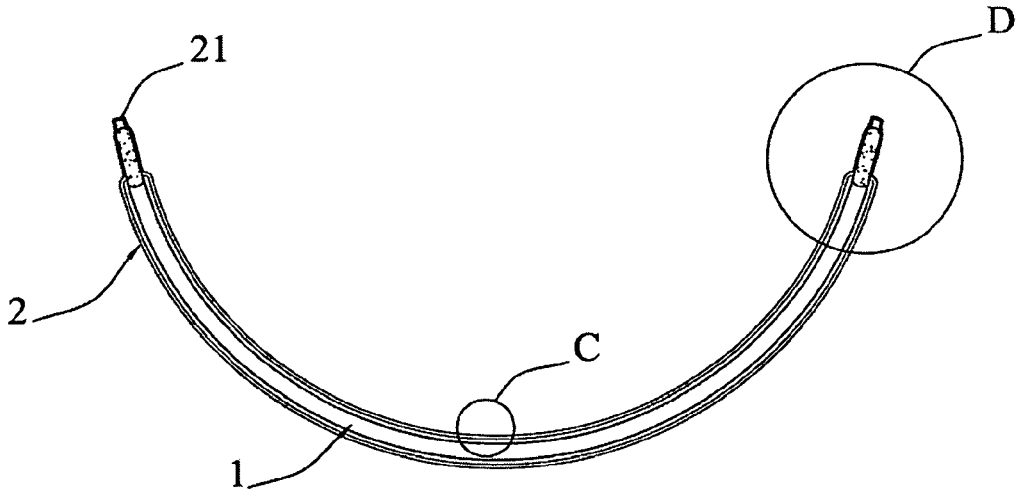
FIG. 6 illustrates a perspective view of the second embodiment.

To ensure wearers that users do not to feel the existence of the rigid underwire when in use, and to further enhance the comfort, and also to enhance the underwire's life and its resistance to potential degradation from sweat and laundry detergents, the present disclosure inserts the entire said underwire 1 into a transparent thermally contractible case 2, as shown in FIG. 6. The two ends of the arc-shaped underwire 1 are reliably enclosed by the two ends of the thermally contractible case 2.

Figure 7:
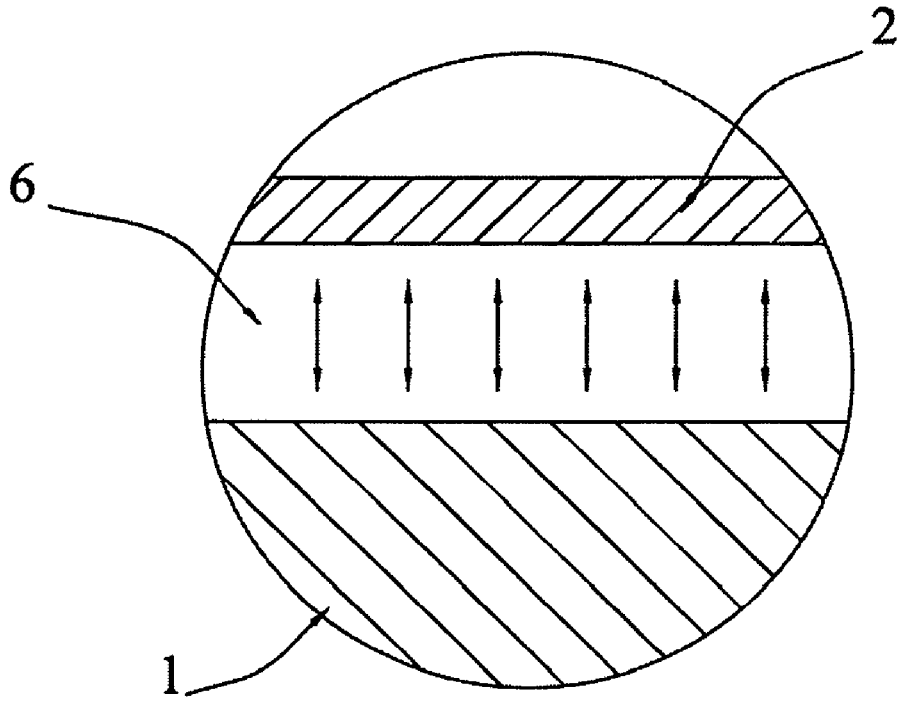
FIG. 7 illustrates an enlarged view of C in FIG. 6.

The external end of the case which extends out of the tip of the underwire is a soft tube 21, and an air cushion 6 is formed between the case and the surface of the underwire, as shown in FIG. 7. The air cushion makes the bra support exceptionally elastic as indicated by the arrows in FIG. 7. In this way users do not feel the existence of the rigid underwire, and the bra provides an enhanced seamless and natural fit that is very comfortable to wear.

Figure 8:
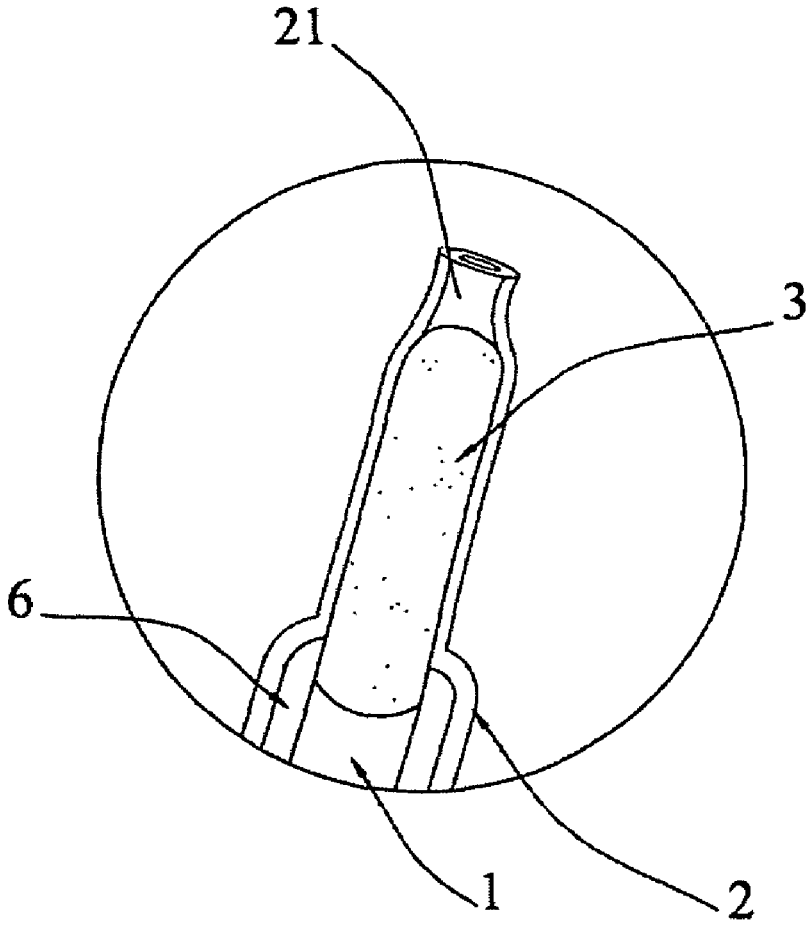
FIG. 8 illustrates a sectional view of D in FIG. 6.
Figure 9:
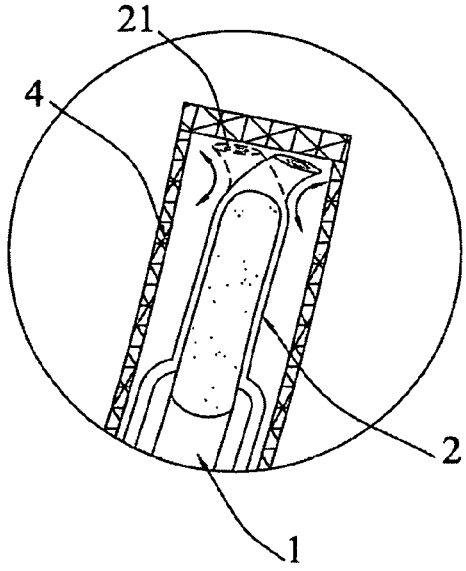
FIG. 9 illustrates an actual constitutional view of the second embodiment.

In the process of manufacturing the bra support, the two ends of the underwire can be punch sheared, and then coated with paint. The thermally contractible case 2 with proper size is inserted into the end of the underwire and is placed into an upright oven with a set temperature, so the thermally contractible case 2 can contract naturally and tightly wrapped around the body of the underwire 1, as shown in FIG. 8.

Further, this manufacturing process is exceptionally simple and the production cost is low. The underwire 1 in the present disclosure is sheared off after the steel wire is bent by a wire bending machine, and is then inserted into the thermally contractible case 2. Therefore, the underwire can not be easily broken even if it is under a great pressure.

When the support is in use, both sides of the soft tube receive an equal force, and this positions the tip of the underwire 1 right at the end stitches of the sleeve 4, thus holes are unlikely to be made, and poke-throughs are efficiently prevented. The present disclosure not only can effectively prevent injuries to users caused by poking through underwire, but also can provide safe and comfortable use.

Figure 10:
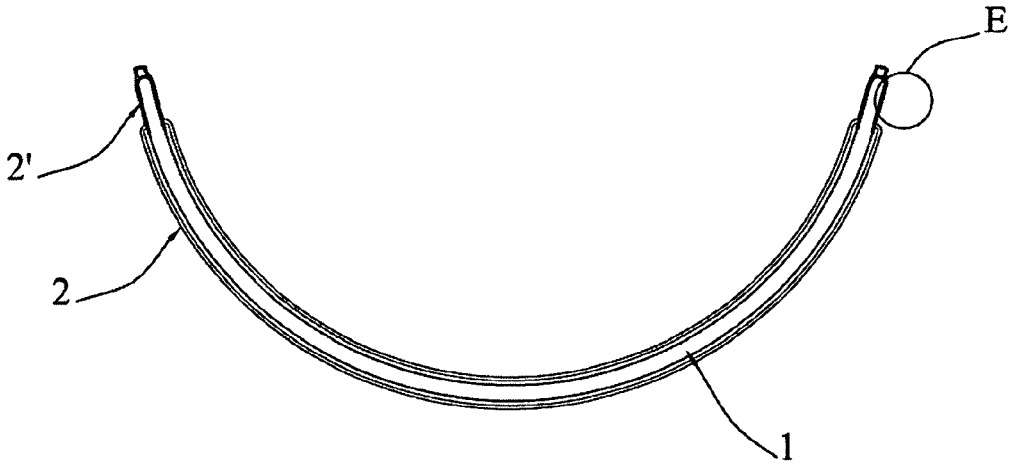
FIG. 10 illustrates a perspective view of the third embodiment.
Figure 11:
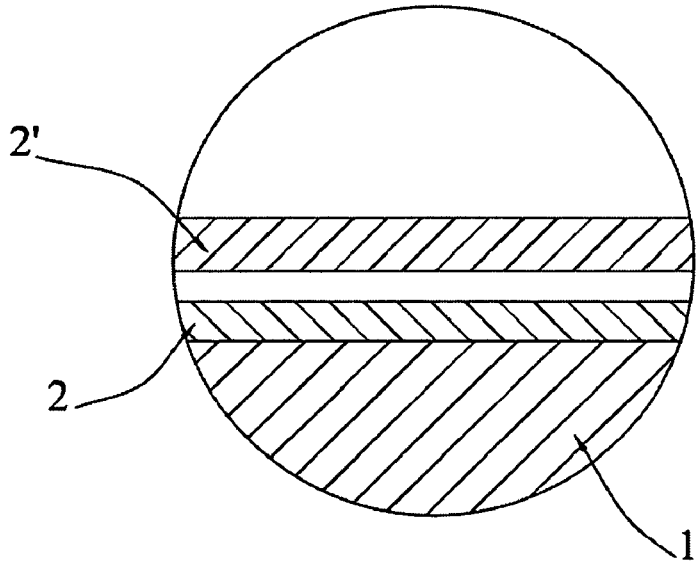
FIG. 11 illustrates a sectional view of E in FIG. 10.

To further enhance the reliability of this structure and make it even safer and more comfortable to use, two sets of the thermally contractible cases 2 and 2' can be inserted into the underwire 1, as shown in FIG. 10 and FIG. 11. First, the thermally contractible case 2' is inserted into each end of the underwire; second, thermally contractible case 2 is inserted into the entire said underwire with the thermally contractible 2' already inserted. The two ends of the outer thermally contractible case 2 are tightly wrapped around the surface of the underwire 1 and the thermally contractible case 2' at each end of the underwire 1, and the external end of the case 2 extending out and forming a bendable soft tube 21. An air cushion 3 is also formed between the surface of the arc-shaped underwire and the case 2.

Figure 12:
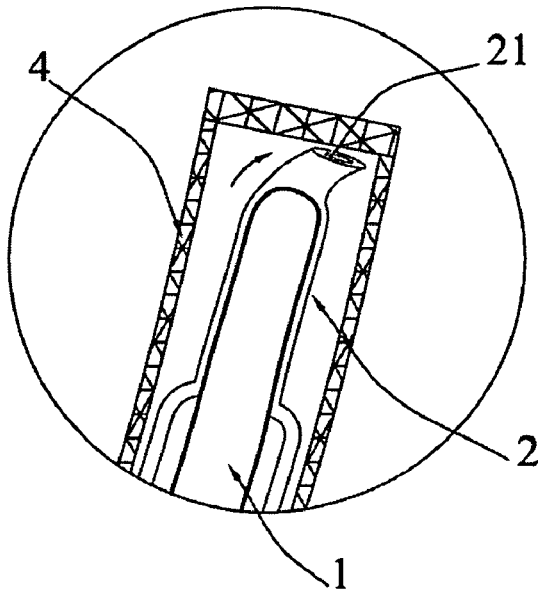
FIG. 12 illustrates an actual constitutional view of the third embodiment.

The soft tube 21 bends to one side and this positions the end stitches of the sleeve 4 right at the tip of the underwire, thus holes are unlikely to occur and poke-throughs can be very efficiently prevented. Thus injuries to users caused by the underwire poking through the fabric will not occur as shown in FIG. 12. The present disclosure can be widely used in a variety of brassieres of undergarments, swimming suites and evening gowns.

Although the present disclosure has been described in certain exemplary preferred embodiments, many modifications and variations would be apparent to those skilled in the art. It is therefore understood that the present disclosure may be practiced otherwise than as specifically described herein. Hence, those preferred embodiments described in the present disclosure should be considered in all respects as illustrative and not restrictive.

What is claimed is:

1. A safety bra support with underwire sleeves comprises:

an arc-shaped steel wire having at least two ends forming an underwire enclosed with at least one set of thermal contractible cases made of polymeric materials; and a bendable and flexible soft tube formed of an external end of the set of thermally contractible cases protruding out of the arc-shaped underwire, capable of ensuring the tips of the two ends of the underwire be placed right at the end stitches of a sleeve.

2. The safety bra support as claimed in claim 1, wherein the thermally contractible cases are made of polyethylene.

3. The safety bra support as claimed in claim 1, wherein the two ends of the arc-shaped underwire are coated with protective paint.

4. The safety bra support as claimed in claim 3, wherein the arc-shaped underwire is inserted entirely into the set of thermally contractible cases wherein two ends of said thermally contractible cases enclose the two tips of the arc-shaped underwire; and an air cushioned space is naturally formed between the thermally contractible cases and the surface of the arc-shaped underwire.

5. The safety bra support as claimed in claim 3, wherein the arc-shaped underwire is tightly wrapped by one set of thermally contractible cases, and no air cushioned space is formed between the thermally contractible cases and the surface of the underwire.

6. The safety bra support as claimed in claim 3, wherein the arc-shaped underwire is inserted into and double enclosed by two sets of thermally contractible cases.

7. The safety bra support as claimed in claim 6, wherein each end of the underwire is inserted into and enclosed by a first set of the two sets of thermally contractible cases and the entire underwire is then inserted into and enclosed by a second set of thermally contractible cases on top of the first set of thermally contractible cases, the two ends of the arc-shaped underwire are wrapped by the two ends of the second set of thermal contractible cases whose external ends protrude out of the tips of the arc-shaped underwire to form the soft tube; and an air cushioned space is naturally formed between the thermally contractible cases and the underwire.

8. The safety bra support as claimed in claim 6, wherein the underwire is inserted entirely into and enclosed by two sets of thermally contractible cases, the two ends of the arc-shaped underwire are wrapped by the ends of both sets of the thermally contractible cases whose external ends protrude out of the tips of the arc-shaped underwire to form the soft tube;

and an air cushioned space is naturally formed between the two sets of thermally contractible cases.

9. The safety bra support as claimed in claim 1, wherein the two ends of the arc-shaped underwire are enclosed with the set of thermally contractible cases respectively.

10. The safety bra support as claimed in claim 1, wherein the arc-shaped underwire is inserted entirely into the thermally contractible cases whose two ends enclose the two tips of the arc-shaped underwire; and an air cushioned space is naturally formed between the thermally contractible cases and the surface of the arc-shaped underwire.

11. The safety bra support as claimed in claim 1, wherein the arc-shaped underwire is inserted into and enclosed by two sets of thermally contractible cases.

12. The safety bra support as claimed in claim 11, wherein each end of the underwire is inserted into and enclosed by a first set of the two sets of thermally contractible cases and the entire underwire is then inserted into and enclosed by a second set of thermally contractible case on top of the first set of thermally contractible cases, the two ends of the arc-shaped underwire are wrapped by the two ends of the second set of thermally contractible cases whose external ends protrude out of the tips of the arc-shaped underwire to form the soft tube; and an air cushioned space is naturally formed between the thermally contractible cases and the underwire.

13. The safety bra support as claimed in claim 11, wherein the underwire is inserted entirely into and enclosed by two sets of thermally contractible cases, the two ends of the arc-shaped underwire are wrapped by the ends of both sets of the thermally contractible cases whose external ends protrude outwardly beyond the tips of the arc-shaped underwire to form the soft tube; and an air cushioned space is naturally formed between the two sets of thermally contractible cases.

* * * * *